US005282448A

United States Patent [19]

Reinke et al.

[11] Patent Number: 5,282,448

[45] Date of Patent: Feb. 1, 1994

[54] FUEL CONTROL OF A TWO-STROKE ENGINE WITH OVER-CENTER THROTTLE BODY

[75] Inventors: Paul E. Reinke, Rochester; Steven D. Stiles, Clarkston, both of Mich.

[73] Assignee: General Motors Corporation, Detroit, Mich.

[21] Appl. No.: 24,140

[22] Filed: Mar. 1, 1993

[51] Int. Cl.[5] ..... F02D 9/08

[52] U.S. Cl. ..... 123/337; 123/339; 123/403

[58] Field of Search ..... 123/337, 339, 403

[56] References Cited

U.S. PATENT DOCUMENTS

| | | | |
|---|---|---|---|
| 4,391,247 | 7/1983 | Shioyama et al. | 123/403 |
| 4,462,358 | 7/1984 | Ishida et al. | 123/337 |
| 4,474,150 | 10/1984 | Foley et al. | 123/337 |
| 4,491,106 | 1/1985 | Morris | 123/337 |
| 4,905,647 | 3/1990 | Kizer et al. | 123/403 X |
| 4,932,371 | 6/1990 | Albertson et al. | 123/73 SP |
| 4,955,341 | 9/1990 | Trombley et al. | 123/339 |
| 4,981,123 | 1/1991 | Schatz | 123/403 |
| 5,146,887 | 9/1992 | Gluchowski et al. | 123/337 |

FOREIGN PATENT DOCUMENTS

| | | | |
|---|---|---|---|
| 3205160 | 8/1983 | Fed. Rep. of Germany | 123/337 |
| 11135 | 1/1991 | Japan | 123/337 |

OTHER PUBLICATIONS

*Research Disclosure* #32386 "Two-Stroke Engine Control" published Mar. 1991, p. 200.

*Primary Examiner*—Willis R. Wolfe
*Attorney, Agent, or Firm*—Karl F. Barr

[57] ABSTRACT

An engine control system is disclosed for reducing the hydrocarbon content in the exhaust gas of a crankcase scavenged, two-stroke engine in the operating range near idle, with light operator induced engine loading. As operator demand for engine output power is increased, the system increases the fuel per cylinder supplied to the engine while restricting the supplied mass of air per cylinder to a value less than that flowing at unloaded engine idle.

2 Claims, 3 Drawing Sheets

FUEL CONTROL OF A TWO-STROKE ENGINE WITH OVER-CENTER THROTTLE BODY

BACKGROUND OF THE INVENTION

1. Field of the Invention

The invention relates to engine control for a crankcase scavenged, two-stroke engine, and more particularly to a system for reducing the exhaust gas hydrocarbons emitted from such an engine at and slightly above idle speed and low power requirements, by controlling the quantity of intake air and fuel delivered to the engine.

2. Description of the Relevant Art

In conventional four-stroke engines, as operator demand for engine power is increased from idle, the amount of air per cylinder supplied to the engine is typically increased. As air per cylinder is increased, the quantity of fuel delivered per cylinder is also increased, thereby maintaining the desired air-fuel ratio to achieve the desired engine performance and emission objectives.

The structure and operation of crankcase scavenged, two-stroke engines differ in many respects from that of conventional four-stroke engines. One difference concerns the manner in which fresh air is inducted, and burned fuel is exhausted by the engines. Conventional four-stroke engines have intake and exhaust valves within the cylinders to accomplish these tasks. Crankcase scavenged, two-stroke engines do not employ intake and exhaust valves but rather, intake and exhaust ports which open directly through the walls of the engine cylinders. As combustion is initiated, the piston moves in its downstroke within a cylinder, uncovering the exhaust port for release of the burned fuel, and shortly thereafter, uncovering the intake port to enable the entry of a fresh air charge, and assist in expulsion of the combustion components of the burned fuel.

A problem associated with crankcase scavenged, two-stroke engines has been the high level of hydrocarbons present in the exhaust gas. At speeds near engine idle, with light operator induced loading, the level of exhaust gas hydrocarbons is highly dependent upon the amount of air per cylinder delivered to the engine. This relationship is thought to result from the absence of valves in the two-stroke engine, and the near simultaneous opening of the exhaust and intake ports during the engine operating cycle. Presumably, an excessive quantity of air flowing through the intake port forces an amount of unburned fuel out of the exhaust port thereby increasing the hydrocarbon content of the exhaust gas.

If the conventional practice of increasing the mass air per cylinder flowing to the engine is followed in controlling the near idle operation of a crankcase scavenged, two-stroke engine upon operator demand for output power, the level of hydrocarbons in the engine exhaust may be unreasonably high. Consequently, a need exists for an alternative engine control for such engines operating at speeds near idle, with light operator induced loading.

SUMMARY OF THE INVENTION

In accordance with the present invention, as the operator demand for engine power increases, over a defined range of engine operation near idle, the fuel per cylinder delivered to the engine is increased, however, the air per cylinder delivered to the engine is restricted, to be less than that delivered at unloaded engine idle. This results in a reduced level of hydrocarbons in the exhaust gas for the crankcase scavenged two-stroke engine, even though this practice is contrary to that typically used with four-stroke engines.

According to the invention, exhaust gas hydrocarbons are reduced by decreasing the mass of air per cylinder delivered to the engine, from that delivered at unloaded engine idle, as the demand for engine output is increased. Preferably this is accomplished by utilizing a throttle body with over center travel such that operator demand for an increase in power results in an initial throttle plate movement which decreases the mass of air per cylinder delivered to the engine through a reduction in the throttle bore area. Beyond the over-center position of the throttle blade, with respect to the throttle bore, continued operator demand for power results in an increase in air flow. Concurrently with the rotation of the throttle plate, a throttle position sensor relates information regarding the throttle position to the engine electronic control module (ECM) to be used as input for engine fueling. Any increase in throttle position is translated into an increase in the quantity of fuel delivered to the cylinder. Consequently, fuel is increased with a reduction in mass of air per cylinder as demand for engine power is increased from an idle condition.

Other objects and features of the invention will become apparent by reference to the following description and to the drawings.

DESCRIPTION OF THE PREFERRED EMBODIMENT

Figure 1:
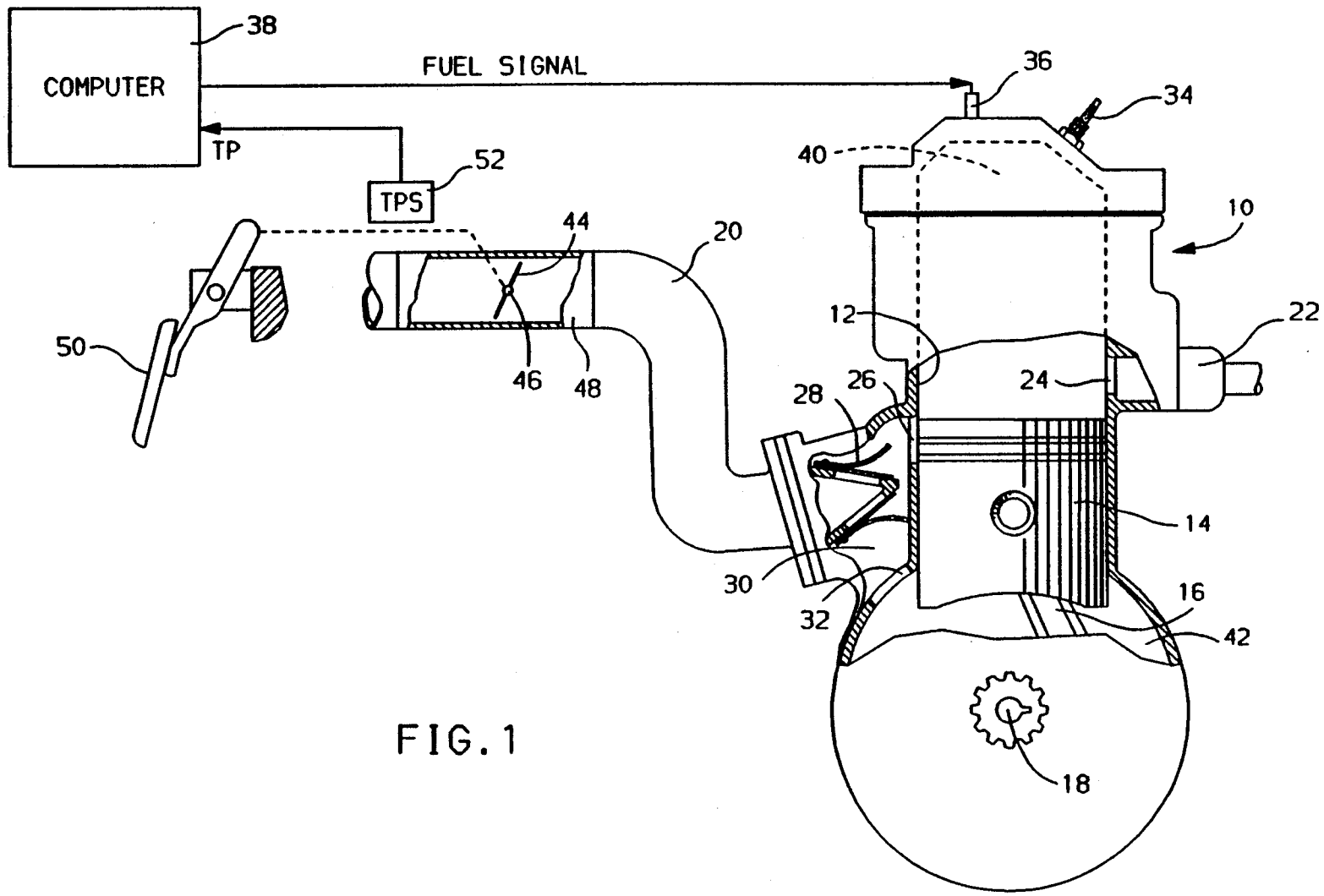
FIG. 1 is a schematic diagram of a crankcase scavenged two-stroke engine system embodying the present invention.

Referring to FIG. 1 there is shown schematically a crankcase scavenged, two-stroke engine, designated generally as 10, with a portion of the engine exterior cut away, exposing cylinder 12. Piston 14 resides within cylinder 12 and is mounted to connecting rod 16 and crankshaft 18 for reciprocating motion therein. Operably connected to the engine is intake manifold 20 and exhaust manifold 22. Cylinder 12 communicates with the exhaust manifold 22 through exhaust port 24 in the wall of cylinder 12. Intake manifold 22, likewise communicates with cylinder 12 through intake port 26. A reed valve checking mechanism 28 may be situated at the entrance to a common air transfer passage 30 which links crankcase port 32 with the intake port 26 in the wall of cylinder 12. Cylinder 12 is provided with a spark plug 34 and a fuel injector 36 which is preferably of the electronic solenoid driven type.

Electronic control module (ECM) 38 is typically a conventional digital computer used by those skilled in the art of engine control, and includes the standard elements of a central processing unit, random access memory, read only memory, analog-to-digital converter, input/output circuitry, and clock circuitry. The computer 38 is suited to receive information on various engine parameters from sensors connected to the engine. Upon receipt of such information, the computer 38 performs required computations and provides output signals which are transmitted to various operating systems which affect the operation of the engine.

The operation of the engine 10 will now be briefly described based on the cycle operating in cylinder 12. During the upstroke, piston 14 moves from its lowest position in cylinder 12 toward top dead center. During the upward movement of the piston 14, air intake port 26 and exhaust port 24 are closed off from the combustion chamber 40, with air being inducted into crankcase chamber 42 through reed valve mechanism 28. Air in combustion chamber 40 is mixed with fuel from injector 36 and compressed until the spark plug 34 ignites the compressed mixture near the top of the stroke. As combustion is initiated, the piston 14 begins its downstroke, decreasing the volume of crankcase chamber 42 and the inducted air within. The air within the crankcase is prevented from escape through the intake manifold 20 by closure of the reed valve mechanism 28. Toward the end of the downstroke, piston 14 uncovers exhaust port 24 to release the combusted fuel, followed by an uncovering of the intake port 26, enabling the air compressed within the crankcase chamber 42 to flow through the air transfer passage 30 and into cylinder 12. The cycle begins anew when piston 14 reaches the bottom of its travel in cylinder 12.

Typically, in a four-stroke engine, as the operator demand for engine power is increased, the quantity of air supplied to each cylinder is increased. With an increase in air per cylinder come an increase in fuel per cylinder thereby maintaining a desired air-fuel ratio and engine power output. In the crankcase scavenged, two-stroke engine 10 to which the present invention is applied, at speeds near idle, the level of exhaust gas hydrocarbons is highly dependent upon the quantity of air per cylinder delivered to the engine. This relationship is thought to result from the absence of valves in the engine 10, and the near simultaneous opening of intake port 26 and exhaust port 24 for brief periods of the engine operating cycle. Presumably, excessive air flowing through intake port 26 forces unburned fuel through the open exhaust port 24 thereby increasing hydrocarbon emissions.

Figure 5:
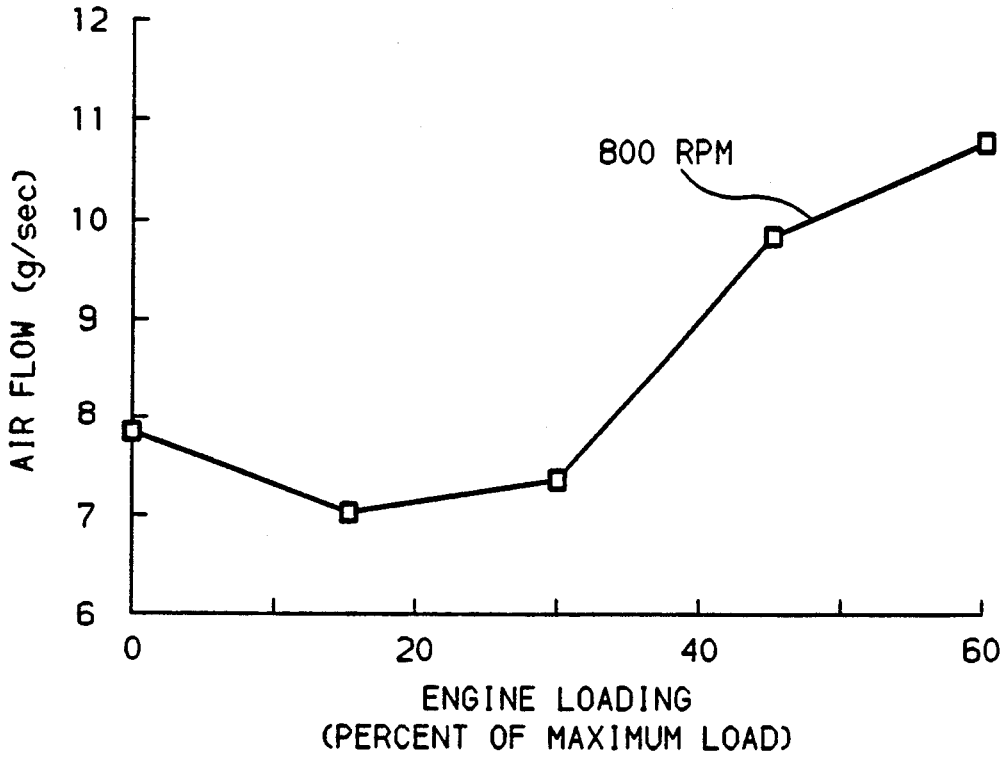
FIG. 5 is a graphical representation illustrating the airflow required for optimum engine emission performance.

Referring now to FIG. 5, there is shown a graph of typical speed load data for a crankcase scavenged, two-stroke engine. The data was obtained from standard dynamometer measurements known to those skilled in the art of engine control. The desired engine air flow, to minimize exhaust gas hydrocarbons, is given a function of the percentage of maximum engine loading for an engine speed of 800 RPM. The axis representing percentage of maximum engine loading is also equivalent to the percentage of maximum engine output power demanded by the operator. For an engine operating at the idle speed of 800 RPM, the engine air flow for minimum hydrocarbon emission must be decreased from that at unloaded idle, as operator demand for output power increases to approximately 35 percent of the maximum loading. Thus, if the standard practice of increasing air and fuel flow at off-idle is followed, the level of hydrocarbon emission may be unnecessarily high.

The present invention is directed to a means of controlling the quantity of fuel and air delivered to a crankcase scavenged, two-stroke engine to reduce hydrocarbon emissions when the engine is operated near idle with light operator induced loading. This is accomplished using a throttle body with over-center capability which restricts the mass of air per cylinder delivered to the engine upon initial movement off of its idle position and through a defined range of engine operation.

Figure 2:
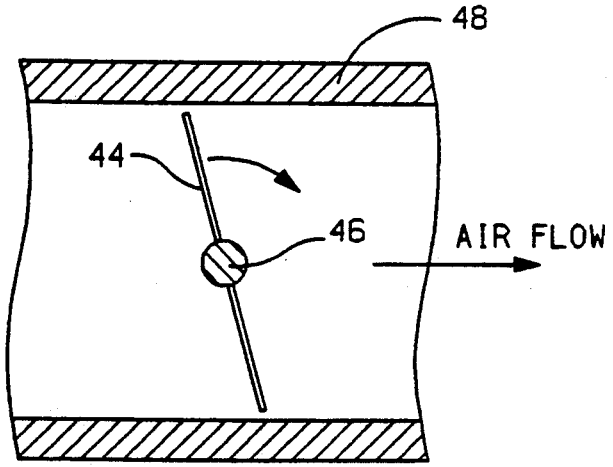
FIG. 2 is an enlarged sectional view of a throttle body for use in the present invention shown with the throttle blade positioned in an idle position below the over-center position.
Figure 3:
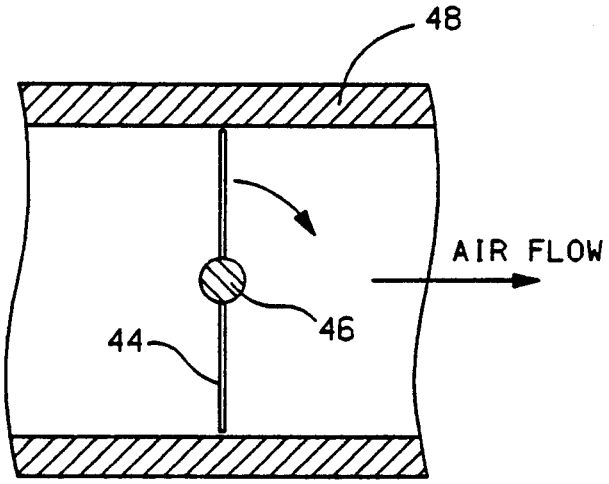
FIG. 3 is a view of the throttle body of FIG. 2 shown with the throttle blade positioned in an off-idle, center position.
Figure 4:
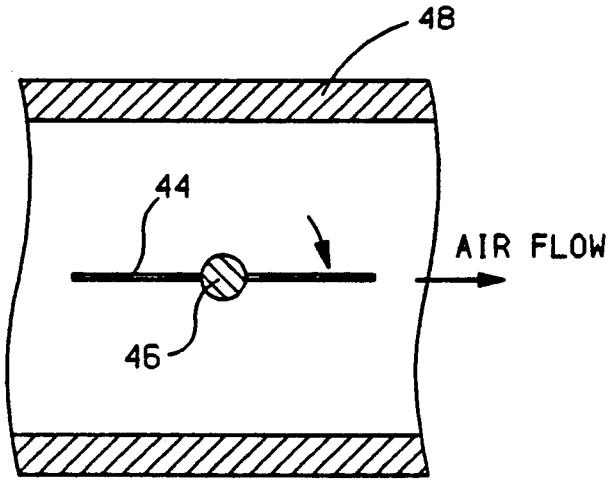
FIG. 4 is a view of the throttle body of FIG. 2 shown with the throttle blade positioned beyond the over-center position.

Referring to FIGS. 2, 3 and 4 throttle plate 44 rotates about a throttle shaft 46 within the throat of throttle body 48 located in the intake manifold 20 to form a valve for controlling the quantity of air per cylinder delivered to the engine 10. Accelerator pedal 50 functions as an operator actuated control element, indicating the engine output power demanded by the operator. The accelerator pedal 50 and the throttle plate 44 may communicate with one another in any number of ways. Accelerator pedal 50 may be an integral part of an electronic pedal module which translates operator input into electrical signals which are transmitted to a throttle position device such as a stepper motor for positioning of the throttle plate 44 in conformity with operator input. Alternately, the throttle plate 44 may be positioned by more conventional means such as a cable or linkage operated on directly by the accelerator pedal 50. In the preferred embodiment, a throttle position sensor 52 supplies a signal TP to ECM 38 indicating the percentage of engine output power demanded by the operator, or equivalently, the percentage of operator induced engine loading. Based on the position of the throttle plate 44 as indicated by the position sensor 52, the ECM 38 is able to calculate the quantity of fuel per cylinder to supply to the engine 10. As throttle position increases from an idle position illustrated in FIG. 3 to the open throttle position of FIG. 4, fuel per cylinder is increased.

Although the use of throttle position sensor 52 is the preferred means by which the fuel is increased as the throttle plate 44 is rotated upon increased operator demand for engine power, it is contemplated that other means for increasing fuel, which dispense with position sensor 52, may also be used.

Again referring to FIGS. 2, 3 and 4, a throttle body 48 of the type presently described having provision for over-center travel is illustrated. The throttle plate 44 in the over-center throttle body 48 has a range of rotation which extends from the wide open throttle (WOT) position of FIG. 4 in which the throttle plate 44 is substantially parallel to the flow of air through the throttle body 48 and the throttle bore area available for air flow is maximized, to the idle position of FIG. 2, corresponding to a steady state unloaded engine, in which the throttle plate 44 is positioned at a negative throttle angle relative to the fully closed, or centered location shown in FIG. 3 in which the throttle plate 44 is positioned substantially perpendicular to the flow of air through the throttle body 48 and the throttle bore area available for air flow is minimized.

Figure 6:
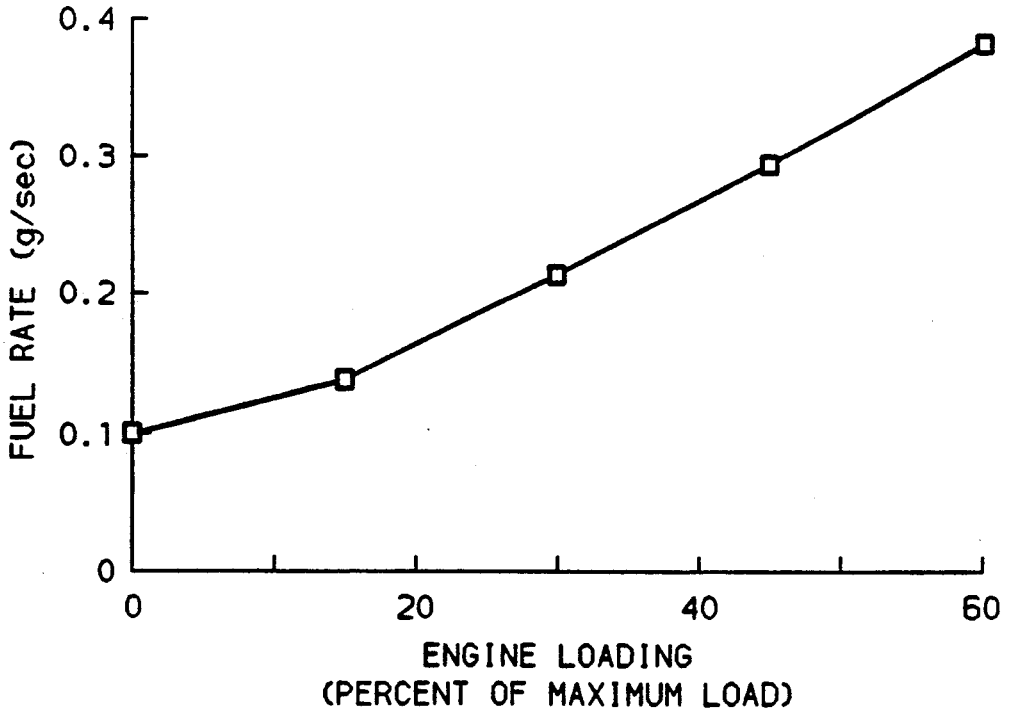
FIG. 6 is a graphical representation illustrating the fuel rate required for optimum emission performance as power demand is increased.

As the accelerator pedal 50 is moved from its initial, idle position with increased operator demand for engine output, the throttle plate 44 rotates from the idle position in a clockwise direction as viewed in FIGS. 2, 3 and 4. Initially, as the throttle plate approaches the centered position of FIG. 3, the throttle bore area is reduced thereby reducing air flow to the engine while fuel is increased due to rotation of the throttle plate 44 from the idle position. The simultaneous operation of the throttle bore area decreasing and the increased rotation of the throttle plate 44 as, translated by the position sensor 52, resulting in an increase in fuel rate, accomplishes the goal of decreasing air flow to the engine (FIG. 5) while simultaneously increasing fuel rate (FIG. 6). As operator demand for engine output continues to increase, moving the throttle plate 44 through the centered position of FIG. 3, the throttle body operation resembles that of a conventional throttle body in that an increase in operator demand for engine power results in an increase in engine air flow and fuel rate.

The fuel control system described for application to a crankcase scavenged, two-stroke engine uses an over-center throttle body to reduce the flow of air to the engine in off-idle situations while allowing for increasing fuel to be supplied to the engine based on the position of the throttle plate. The present system eliminates the need for complex linkages or electronically actuated air bypass valves which are prone to durability and cost concerns.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiments may be modified in light of the above teachings. The embodiment described was chosen to provide an illustration of the principles of the invention and its practical application to thereby enable one of ordinary skill in the art to utilize the invention in various embodiments and with various modifications as are suitable to the particular use contemplated. Therefore, the foregoing description is to be considered exemplary, rather than limiting, and the true scope of the invention is that described in the following claims.

The embodiments of the invention in which an exclusive property or privilege is claimed are defined as follows:

1. A control system for reducing hydrocarbon emissions in the exhaust gas of a crankcase scavenged, two-stroke engine, comprising an air intake manifold for induction of air to the engine, said manifold having a throttle body with a bore through which engine air flows and a throttle plate positioned in said bore and rotatable therein to regulate the flow of air therethrough, said throttle plate rotatable from a positive position of maximum air flow and minimum bore obstruction through a center position of minimum air flow and maximum bore obstruction to a negative position corresponding to an air flow and bore obstruction representing a steady state condition of unloaded engine idle and operable to reduce air flow to said engine as said throttle plate is rotated from said negative, steady state position to said center position and to increase air flow to said engine as said throttle plate is rotated from said center position to said positive position, said manifold further comprising throttle plate position sensing means operable to increase fuel supplied to the engine as said throttle plate rotates from said negative position to said positive position, said control system operable to reduce air and increase fuel to said engine as said throttle plate rotates from said negative, idle position through said center position and to increase air flow and fuel flow as said throttle plate rotates from said center position to said positive position.

2. A control system for reducing hydrocarbon emissions in the exhaust gas of a crankcase scavenged, two-stroke engine, comprising an air intake manifold for induction of air to the engine, said manifold having a throttle body with a bore through which the engine air flows and a throttle plate positioned in said bore and rotatable therein to regulate the flow of air therethrough, said throttle plate rotatable from a positive position of maximum air flow and minimum bore obstruction through a center position of minimum air flow and maximum bore obstruction to a negative position corresponding to an air flow and bore obstruction representing a steady state condition of unloaded engine idle and operable to reduce air flow to said engine as said throttle plate is rotated from said negative, steady state position to said center position and to increase air flow to said engine as said throttle plate is rotated from said center position to said positive position, said system further comprising means for increasing fuel to said engine as said throttle plate rotates from said negative position through said center position to said positive position, said control system operable to reduce air flow and increase fuel to said engine as said throttle plate rotates from said negative, idle position through said center position and to increase air flow and fuel flow to said engine as said throttle plate rotates from said center position to said positive position.

* * * * *